US007122977B2

(12) United States Patent
Ueno et al.

(10) Patent No.: US 7,122,977 B2
(45) Date of Patent: Oct. 17, 2006

(54) CATHODE-RAY TUBE APPARATUS

(75) Inventors: Hirofumi Ueno, Fukaya (JP); Tsutomu Takekawa, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/845,452

(22) Filed: May 14, 2004

(65) Prior Publication Data

US 2004/0212327 A1 Oct. 28, 2004

Related U.S. Application Data

(63) Continuation of application No. PCT/JP02/11892, filed on Nov. 14, 2002.

(30) Foreign Application Priority Data

Nov. 16, 2001 (JP) ..... 2001-352021
Jun. 13, 2002 (JP) ..... 2002-172633

(51) Int. Cl.
*G09G 1/04* (2006.01)

(52) U.S. Cl. ..... 315/364; 315/16; 315/368.15; 315/382; 313/415; 313/447; 313/449; 313/452

(58) Field of Classification Search ..... 315/14–16, 315/364, 368.15, 368.27, 382, 382.1, 411, 315/366; 313/409, 413, 414, 421, 429, 440, 313/446–449, 452, 415

See application file for complete search history.

(56) References Cited

U.S. PATENT DOCUMENTS 6,225,765 B1 * 5/2001 Yatsu et al. ..... 315/382
6,555,975 B1 * 4/2003 Satou et al. ..... 315/364
6,570,349 B1 * 5/2003 Kimiya et al. ..... 315/382
6,586,868 B1 * 7/2003 Takekawa et al. ..... 313/414
2001/0028212 A1 10/2001 Kimiya et al.
2002/0047508 A1 4/2002 Satou et al.

FOREIGN PATENT DOCUMENTS

| | | |
|---|---|---|
| CN | 1232285 A | 10/1999 |
| CN | 131987 1 A | 10/2001 |
| JP | 1-60448 | 4/1989 |
| JP | 7-220648 | 8/1995 |
| JP | 9-180648 | 7/1997 |
| JP | 9-237588 | 9/1997 |
| JP | 2000-306522 | 11/2000 |
| JP | 2000-331624 | 11/2000 |
| JP | 2001-84921 | 3/2001 |
| JP | 2001-283751 | 10/2001 |
| JP | 2002-83557 | 3/2002 |

* cited by examiner

*Primary Examiner*—Haissa Philogene
(74) *Attorney, Agent, or Firm*—Oblon, Spivak, McClelland, Maier & Neustadt, P.C.

(57) ABSTRACT

A prefocus lens section is formed by a screen electrode and an additional electrode. A main lens section is formed by a focus electrode, an anode electrode and an intermediate electrode that is disposed between the focus electrode and the anode electrode. Each of the focus electrode and the intermediate electrode has a cylindrical electrode on at least one of opposed faces thereof. The intermediate electrode and the anode electrode have cylindrical electrodes on opposed faces thereof. A voltage with a level higher than a focus voltage and lower than an anode voltage is applied to the additional electrode and the intermediate electrode.

17 Claims, 10 Drawing Sheets

CATHODE-RAY TUBE APPARATUS

CROSS-REFERENCE TO RELATED APPLICATIONS

This is a Continuation Application of PCT Application No. PCT/JP02/11892, filed Nov. 14, 2002, which was not published under PCT Article 21 (2) in English.

This application is based upon and claims the benefit of priority from prior Japanese Patent Applications No. 2001-352021, filed Nov. 16, 2001; and No. 2002-172633, filed Jun. 13, 2002, the entire contents of both of which are incorporated herein by reference.

BACKGROUND OF THE INVENTION

1. Field of the Invention

The present invention relates generally to a cathode-ray tube apparatus and more particularly to a color cathode-ray tube apparatus capable of improving an oval distortion of a beam spot, which is formed by an electron beam that is focused on a peripheral portion of a phosphor screen, and stably providing a high image quality with high resolution over the entire phosphor screen.

2. Description of the Related Art

In general, a self-convergence type in-line color cathode-ray tube apparatus comprises an in-line electron gun assembly for emitting three in-line electron beams, which travel on a horizontal plane. A dynamic focus type electron gun assembly, which is a type of in-line electron gun assembly, includes three in-line cathodes K, and first to fourth grids G1 to G4 that are successively arranged toward a phosphor screen, as shown in FIG. 17.

In this electron gun assembly, a voltage of about 190 V is applied to the cathodes K. The first grid G1 is grounded, and a voltage of about 800 V is applied to the second grid G2. A focus voltage of about 7 kV is applied to a first segment G3-1 of the third grid, and a reference voltage of about 7 kV is applied to a second segment G3-2 of the third grid. A high voltage of about 30 kV is applied to the fourth grid G4. An AC component, which varies in a parabolic fashion in accordance with a distance of deflection of an electron beam, is superimposed on the reference voltage that is applied to the second segment G3-2.

Thus, the cathodes K, first grid G1 and second grid G2 form an electron beam generating section that generates electron beams and forms an object point for the main lens. The second grid G2 and the third grid G3 form a prefocus lens that prefocuses the electron beams generated from the electron beam generating section. The third grid G3 and fourth grid G4 form a main lens that ultimately focuses the electron beams, which are prefocused by the prefocus lens, on a phosphor screen.

When the electron beams are deflected onto a corner area of the phosphor screen, the potential difference between the second segment G3-2 and the fourth grid G4 takes a minimum value and also the power of the main lens takes a minimum value. At the sane time, a quadrupole lens is created by a potential difference between the first segment G3-1 and second segment G3-2 of the third grid, and the lens power of the quadrupole lens takes a maximum value. The quadrupole lens is configured to have a focusing function in the horizontal direction and a diverging function in the vertical direction.

Thus, the movement of the focal point is compensated by decreasing the power of the main lens, as the distance between the electron gun assembly and phosphor screen increases and the image point moves farther. In addition, the quadrupole lens compensates a deflection aberration due to the deflection magnetic fields.

In recent years, with an increasing popularity of Hi-Vision broadcast and Internet TV, there is a demand that a color cathode-ray tube should display an image with higher definition. In order to display a high-definition image, it is desirable that a small beam spot with a substantially circular shape be formed over the entire phosphor screen.

In order to form a small beam spot, it is effective to decrease the magnification of the main lens. An example of a method for decreasing the magnification is to increase the aperture of the main lens. Jpn. Pat. Appln. KOKAI Publication No. 9-180648 discloses a method of increasing the aperture of the main lens, wherein a superimposition/extension type main lens is used.

As is shown in FIG. 18, the superimposition/extension type main lens includes an intermediate electrode GM that is disposed between the second segment G3-2 and fourth grid G4. The intermediate electrode GM has cylindrical electrodes at its portions opposed to the second segment G3-2 and fourth grid G4, respectively. The second segment G3-2 and fourth grid G4 hare electric field correction plates at their faces opposed to the intermediate electrode GM. Thereby, a superimposition/extension type main lens with a large aperture can be formed.

However, in the case where the focal distance of the lens system in the electron gun assembly is fixed, if the aperture of the main lens is increased, the power of the main lens needs to be increased in order to meet the focusing condition for just focusing electron beams on the phosphor screen. For this purpose, it is necessary to decrease the focus voltage, thereby increasing the potential difference from the anode voltage.

When the focus voltage is decreased, the potential difference between the second grid G2 and first segment G3-1 decreases and the lens power of the prefocus lens lowers. As a result, the divergence angle of the electron beam increases. When the electron beam, whose divergence angle is increased, is incident on the main lens, it is greatly affected by the spherical aberration of the main lens. Consequently, the site of the beam spot of the electron beam that reaches the phosphor screen increases.

When the focus voltage that is applied to the first segment G3-1 is decreased, the potential permeation to the second grid G2 decreases and the potential in the electron beam generating section decreases. Consequently, the size of the imaginary object point of the electron beam for the main lens increases. As a result, the beam spot of the electron beam that reaches the phosphor screen increases.

As has been described above, in the color cathode-ray tube apparatus, in order to display a high-definition, high-resolution image, it is necessary to form a small beam spot with no oval distortion on the entire phosphor screen.

As the method of decreasing the size of the beam spot on the phosphor screen, it is an effective method to increase the aperture of the main lens and decrease the magnification of the main lens. In this method, however, the lens power of the prefocus lens decreases, as mentioned above. Consequently, the divergence angel of the electron beam increases before it enters the main lens, and the electron beam is affected by the spherical aberration on the peripheral region of the main lens. At the same time, in this method, the potential permeation from the first segment to the second grid decreases, and the size of the imaginary object point increases. These phenomena lead to an increase in beam spot size, which is contradictory to the purpose of this method. Hence, it is not possible to form a sufficiently small beam spot on the phosphor screen.

According to a method wherein the focus electrode is elongated in the direction of travel of the electron beam, the focus voltage, which has decreased due to the increase in aperture of the main lens, can be raised. However, in the case where the focus voltage is raised by this method, the size of the electron beam, before entering the main lens, is increased and the electron beam is strongly affected by the spherical aberration of the main lens. As a result, a sufficiently small beam spot cannot be formed on the phosphor screen.

BRIEF SUMMARY OF THE INVENTION

The present invention has been made in consideration of the above-described problems, and its object is to provide a cathode-ray tube apparatus capable of stably displaying a high-definition, high-resolution image.

According to a first aspect of the present invention, there is provided a cathode-ray tube apparatus comprising: an electron gun assembly including an electron beam generating section that generates an electron beam, a prefocus lens section that prefocuses the electron beam generated from the electron beam generating section, and a main lens section that accelerates and focuses the prefocused electron beam onto a phosphor screen; and a deflection yoke that generates deflection magnetic fields for deflecting the electron beam emitted from the electron gun assembly in a horizontal direction and a vertical direction on the phosphor screen, wherein the main lens section includes a focus electrode, to which a focus voltage is applied, an anode electrode, to which an anode voltage with a level higher than the focus voltage is applied, and at least one intermediate electrode, to which a voltage with a level between the focus voltage and the anode voltage is applied, the at least one intermediate electrode being disposed between the focus electrode and the anode electrode, each of the focus electrode, the anode electrode and the intermediate electrode includes, at opposed faces thereof, at least one cylindrical body extending in a direction of travel of the electron beam, and the prefocus lens section includes a screen electrode, to which a voltage with a level lower than the focus voltage is applied, and at least one additional electrode, to which a voltage with a level between the focus voltage and the anode voltage, is applied.

According to a second aspect of the present invention, there is provided a cathode-ray tube apparatus comprising: an electron gun assembly including an electron beam generating section that generates an electron beam, a prefocus lens section that accelerates and prefocuses the electron beam generated from the electron beam generating section, a sub-lens section that further prefocuses the electron beam prefocused by the prefocus lens section, and a main lens section that accelerates and focuses the electron beam prefocused by the sub-lens section onto a phosphor screen; and a deflection yoke that generates deflection magnetic fields for deflecting the electron beam emitted from the electron gun assembly in a horizontal direction and a vertical direction on the phosphor screen, wherein the prefocus lens section includes at least a screen electrode and a first additional electrode, the sub-focus section includes at least the first additional electrode, a second additional electrode, and a focus electrode to which a focus voltage is applied, the main lens section includes the focus electrode, at least one intermediate electrode, and an anode electrode to which an anode voltage with a level higher than the focus voltage is applied, and each of the focus electrode, the intermediate electrode and the anode electrode includes, on at least one of opposed faces thereof, one cylindrical body extending in a direction of travel of the electron beam, a voltage with a level lower than the focus voltage is applied to the screen electrode, a voltage with a level between the focus voltage and the anode voltage is applied to the first additional electrode and the intermediate electrode, and a voltage with a level lower than the focus voltage is applied to the second additional electrode, and the first additional electrode is formed of a cylindrical electrode having electron beam passage holes at end faces thereof that are opposed to the screen electrode and the second additional electrode, and the second additional electrode is formed of a plate electrode with electron beam passage holes.

DETAILED DESCRIPTION OF THE INVENTION

A cathode-ray tube apparatus according to an embodiment of the present invention will now be described with reference to the accompanying drawings.

Figure 1:
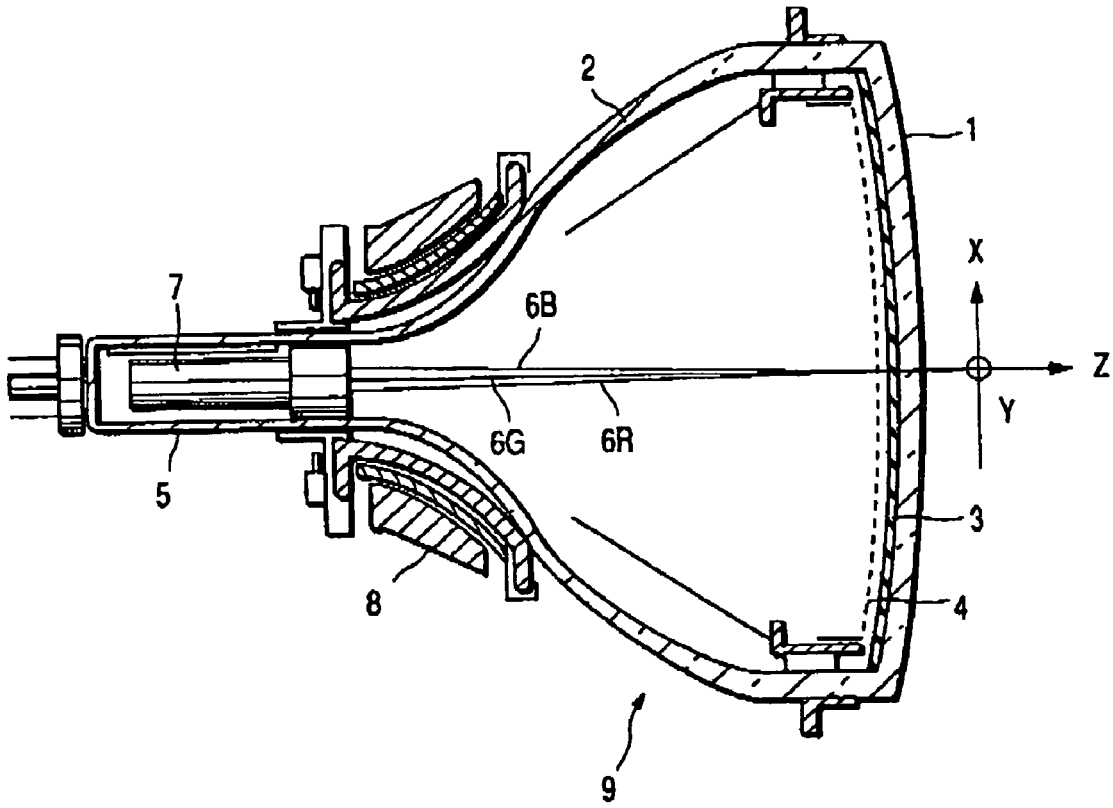
FIG. 1 is a horizontal cross-sectional view that schematically shows the structure of a color cathode-ray tube apparatus according to an embodiment of the present invention.

As is shown in FIG. 1, the cathode-ray tube apparatus, e.g. an in-line color cathode-ray tube apparatus, has a vacuum envelope 9. The vacuum envelope 9 includes a panel 1 and a funnel 2 integrally coupled to the panel 1. A phosphor screen 3 is disposed on an inside surface of the panel 1. The phosphor screen 3 has three-color striped or dot-shaped phosphor layers, which emit blue, green and red light. A shadow mask 4 is disposed to face the phosphor screen 3. The shadow mask 4 has many apertures in its inside part.

An in-line electron gun assembly 7 is disposed within a cylindrical neck 5, which corresponds to a small-diameter portion of the funnel 2. The in-line electron gun assembly 7 emits three in-line electron beams 6B, 6G and 6R (i.e. a center beam 6G and side beams 6B and 6R) which are arranged in line and travel in the same horizontal plane.

A deflection yoke 8 is disposed to extend from a large-diameter portion of the funnel 2 to the neck 5. The deflection yoke 8 generates non-uniform deflection magnetic fields for deflecting the three electron beams 6B, 6G and 6R, which have been emitted from the electron gun assembly 7, in a horizontal direction (X) and a vertical direction (Y). The non-uniform deflection magnetic fields comprise a pincushion-shaped horizontal deflection magnetic field and a barrel-shaped vertical deflection magnetic field.

The three electron beams 6B, 6G and 6R emitted from the electron gun assembly 7 are converged toward the phosphor screen 3 and focused on the associated color phosphor layers on the phosphor screen 3. The three electron beams 6B, 6G and 6R are deflected by the non-uniform deflection magnetic fields generated by the deflection yoke 8 and scanned over the phosphor screen 3 through the shadow mask 4 in the horizontal direction X and vertical direction Y. Thus, a color image is displayed.

Examples of the structure of an electron gun assembly that is applicable to the cathode-ray tube apparatus with the above structure will now be described.

(First Embodiment)

Figure 2:
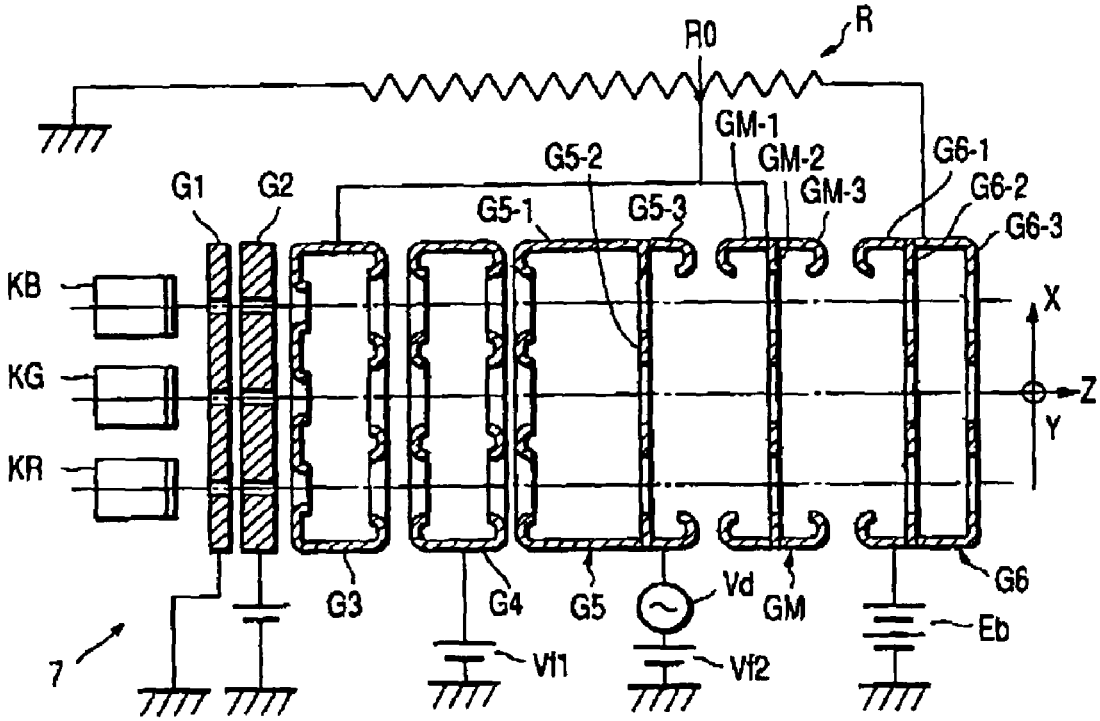
FIG. 2 is a horizontal cross-sectional view that schematically shows the structure of an electron gun assembly according to a first embodiment, which is applicable to the cathode-ray tube apparatus shown in FIG. 1.

As is shown in FIG. 2, an electron gun assembly 7 includes three cathodes K (R, G, B) disposed in line in the horizontal direction X, three heaters for individually heating the cathodes K (R, G, B), and seven electrodes. The seven electrodes, that is, a first grid G1, a second grid (screen electrode) G2, a third grid (additional electrode) G3, a fourth grid (focus electrode) G4, a fifth grid (focus electrode) G5, an intermediate electrode GM and a sixth grid (anode electrode) G6, are disposed in succession from the cathodes K (R, G, B) side toward the phosphor screen. The heaters, cathodes K (R, G, B) and seven electrodes are integrally fixed by a pair of insulation support members.

The first and second grids G1 and G2 are formed of plate electrodes. Each of the plate electrodes has, in Its plate face, three electron beam passage holes, which are formed in line in the horizontal direction X in association with the three cathodes K (R, G, B).

The third grid G3 is formed of an integral cylindrical electrode. The cylindrical electrode has, in each of its faces opposed to the second grid G2 and fourth grid G4, three electron beam passage holes, which are formed in line in the horizontal direction X in association with the three cathodes K (R, G, B).

The fourth grid G4 is formed of an integral cylindrical electrode. The cylindrical electrode has, in each of its faces opposed to the third grid G3 and fifth grid G5, three electron beam passage holes, which are formed in line in the horizontal direction X in association with the three cathodes K (R, G, B). In this embodiment, each of the three electron beam passage holes, which are formed in the face opposed to the fifth grid G5, has a vertically elongated shape with a major axis in the vertical direction Y.

The fifth grid G5 comprises two cylindrical electrodes and one electric field correction plate. Specifically, the fifth grid G5 is constructed by interposing an electric field correction plate G5-2 with electron beam passage holes between two cylindrical electrodes G5-1 and G5-3.

The first cylindrical electrode G5-1 is disposed to face the fourth grid G4. The first cylindrical electrode G5-1 has, in its face opposed to the fourth grid G4, three electron beam passage holes that are formed in line in the horizontal direction in association with the three cathodes K (R, G, B). In this embodiment, each of these electron beam passage holes has a horizontally elongated shape with a major axis in the horizontal direction X.

The electric field correction plate G5-2 is a plate electrode that is disposed on the intermediate electrode GM side of the first cylindrical electrode G5-1. The electric field correction plate G5-2 has, in its plate face, three electron beam passage holes that are formed in line in the horizontal direction in association with the three cathodes K (R, G, B). The second cylindrical electrode G5-3 is disposed on the intermediate electrode GM side of the electric field correction plate G5-2. The second cylindrical electrode G5-3 has, in its face opposed to the intermediate electrode GM, an opening that commonly passes the three electrode beams.

The intermediate electrode GM comprises two cylindrical electrodes and one electric field correction plate. Specifically, the intermediate electrode GM is constructed by interposing an electric field correction plate GM-2 with electron beam passage holes between two cylindrical electrodes GM-1 and GM-3.

The first cylindrical electrode GM-1 is disposed to face the fifth grid G5. The first cylindrical electrode GM-1 has, in its face opposed to the fifth grid G5, an opening that commonly passes the three electrode beams. The electric field correction plate GM-2 is a plate electrode that is disposed on the sixth grid G6 side of the first cylindrical electrode GM-1. The electric field correction plate GM-2 has, in its plate face, three electron beam passage holes that are formed in line in the horizontal direction in association with the three cathodes K (R, G, B). The second cylindrical electrode GM-3 is disposed to face the sixth grid G6. The second cylindrical electrode GM-3 has, in its face opposed to the sixth grid G6, an opening that commonly passes the three electrode beams.

The sixth grid G6 comprises two cylindrical electrodes and one electric field correction plate. Specifically, the sixth grid G6 is constructed by interposing an electric field correction plate G6-2 with electron beam passage holes between two cylindrical electrodes G6-1 and G6-3.

The first cylindrical electrode G6-1 is disposed to face the intermediate electrode GM. The first cylindrical electrode G6-1 has, in its face opposed to the intermediate electrode GM, an opening that commonly passes the three electrode beams. The electric field correction plate G6-2 is a plate electrode that is disposed on the phosphor screen side of the first cylindrical electrode G6-1. The electric field correction plate G6-2 has, in its plate face, three electron beam passage holes that are formed in line in the horizontal direction in association with the three cathodes K (R, G, B).

The second cylindrical electrode G6-3 is disposed on the phosphor screen side of the electric field correction plate G6-2. The second cylindrical electrode G6-3 has, in its end face opposed to the phosphor screen, three electron beam passage holes that are formed in line in the horizontal direction in association with the three cathodes K (R, G, B).

Figure 3:
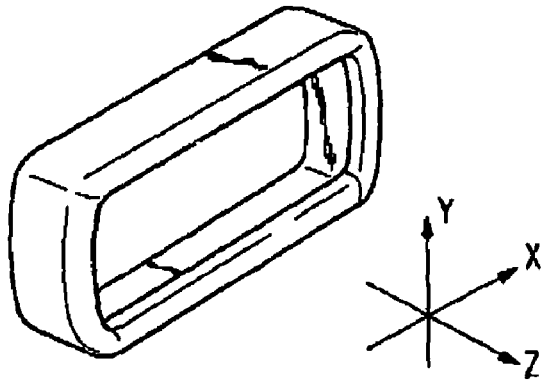
FIG. 3 is a perspective view that schematically shows the structure of a cylindrical electrode, which is applied to the electron gun assembly shown in FIG. 2.
Figure 4:
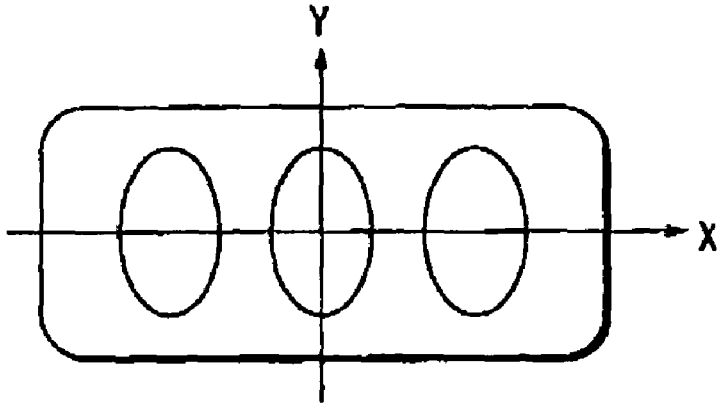
FIG. 4 is a front view that schematically shows the structure of an electric field correction plate, which is applied to the electron gun assembly shown in FIG. 2.

In this embodiment, each of the second cylindrical electrode G5-3 of fifth grid G5, the first cylindrical electrode GM-1 and second cylindrical electrode GM-3 of intermediate electrode GM, and the first cylindrical electrode G6-1 of sixth grid G6 is formed of a cylindrical body that extends in the direction of travel of electron beams, for example, as shown in FIG. 3. Each of the electric field correction plate G5-2 of fifth grid G5, the electric field correction plate GM-2 of intermediate electrode GM and the electric field correction plate G6-2 of sixth grid G6 has non-circular electron beam passage holes each having a major axis in the vertical direction Y, for example, as shown in FIG. 4.

In the electron gun assembly 7 with the above-described structure, a voltage that is produced by superimposing a video signal on a DC voltage of about 190 V, is applied to the cathodes K. The first grid G1 is grounded. A DC voltage of about 800 V is applied to the second grid G2. A fixed DC voltage of about 6.0 kV, that is, a focus voltage Vf1, is applied to the fourth grid G4.

Figure 5:
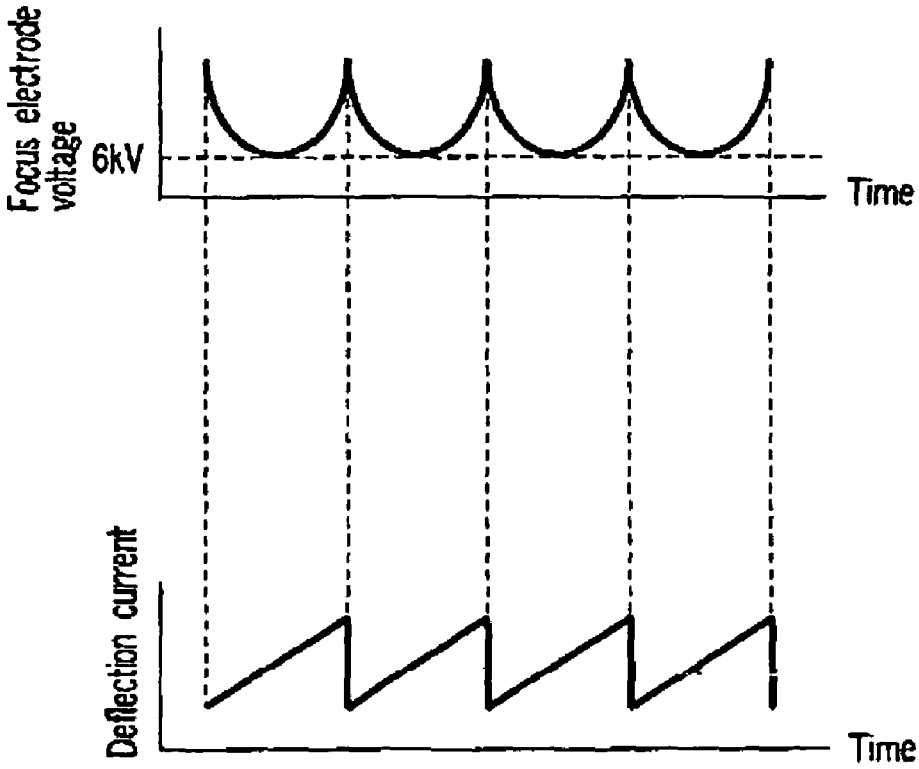
FIG. 5 illustrates a relationship between a voltage, which is applied to a focus electrode, and a deflection current in the electron gun assembly shown in FIG. 2.

The fifth grid G5 is supplied with a dynamic focus voltage that is produced by superimposing a parabolically varying AC voltage component Vd on a fixed DC voltage Vf2 of about 6.0 kV, which is substantially equal to the focus voltage Vf1. This dynamic focus voltage, as shown in FIG. 5, varies in synchronism with a saw-tooth deflection current in a parabolic fashion in accordance with a variation in deflection amount of electron beams. The dynamic focus voltage takes a minimum value of about 6.0 kV and a maximum value of, e.g. about 7.0 kV. An anode voltage Eb of about 30 kV is applied to the sixth grid G6.

The third grid G3 is supplied with a voltage with a level between the focus voltage and the anode voltage, for instance, a voltage of about 18.0 kV. In addition, the intermediate electrode GM is supplied with a voltage with a level between the focus voltage and the anode voltage, for instance, a voltage of about 18.0 kV.

A resistor R is disposed near the electron gun assembly 7 within the neck 5 of the cathode-ray tube apparatus. One end of the resistor R is electrically connected to the sixth grid G6, and the other end of the resistor R is grounded. A voltage, which is obtained by dividing the anode voltage Eb by means of the resistor R, is applied to the third grid G3 and intermediate electrode GM. In this embodiment, the third grid G3 and intermediate electrode GM are electrically connected within the tube and are supplied via a voltage supply terminal R0 with voltages that always have the same level.

In the electron gun assembly 7, the above-mentioned voltages are applied to the respective grids, thereby constituting an electron beam generating section, a prefocus lens section, a sub-lens section, a quadrupole lens section (non-axial-symmetric lens section) and a main lens section.

To be more specific, the electron beam generating section is formed by the cathodes K, first grid G1 and second grid G2. The electron beam generating section generates electron beams and forms an object point for the main lens section. The prefocus lens section is formed by the second grid G2 and third grid G3. The prefocus lens section accelerates and prefocuses electron beams that are generated from the electron beam generating section.

The sub-lens section is formed by the third grid G3 and fourth grid G4. The sub-lens section decelerates and further prefocuses the prefocused electron beams. The main lens section is formed by the fourth grid G4, fifth grid G5, intermediate electrode GM and sixth grid G6. The main lens section is formed of a large-aperture superimposition/extension electron lens. The main lens section accelerates the prefocused electron beams and ultimately focuses them on the phosphor screen.

When electron beams are deflected toward the peripheral area of the phosphor screen, a non-axial-symmetric lens section, which has different focusing powers in the horizontal direction X and vertical direction Y, is created between the fourth grid G4 and fifth grid G5. Specifically, at the time of deflection, the potential difference between the fourth grid G4 and fifth grid G5 increases in accordance with an increase in amount of deflection of electron beams. This potential difference takes a maximum value when the deflection angle of electron beams is maximum. The potential difference creates the non-axial-symmetric lens section, i.e. the quadrupole lens section, between the fourth grid G4 and fifth grid G5. The non-axial-symmetric lens section has a focusing function in the horizontal direction X and a diverging function in the vertical direction Y.

The electron beam emitted from the associated cathode once forms a cross-over while passing through the first grid G1 and second grid G2, and also forms an imaginary object point for the main lens section. In this case, the electron beam is affected by a high degree of potential permeation from the third grid G3, and the formed imaginary object point becomes sufficiently small.

Subsequently, the electron beam passes through the prefocus lens section that is created by the second grid G2 and third grid G3 and undergoes a prefocus function. At this time, since the application voltage to the third grid G3 is relatively high, the electron beam undergoes a strong focusing function both in the horizontal direction and vertical direction, thus forming a small-size electron beam.

Further, the electron beam passes through the sub-lens section that is created by the third grid G3 and fourth grid G4 and undergoes a further prefocus function. In the sub-lens section, the electron beam is decelerated and undergoes a focusing function, but the diameter of the electron beam slightly increases.

Subsequently, the electron beam, which travels to the peripheral area of the phosphor screen, passes through the quadrupole lens section and undergoes an action that compensates a deflection aberration. Specifically, the electron beam undergoes a focusing function in the horizontal direction and a diverging function in the vertical direction. Thereby, horizontal deformation of the beam spot of the electron beam, which reaches the peripheral portion of the phosphor screen, can effectively be improved.

At last, the electron beam enters the main lens section, and the electron beam is finally accelerated toward the phosphor screen and undergoes a final focusing function. Since the main lens section is formed of a large-aperture superimposition/extension electron lens, the magnification of the main lens section can be limited to a small value. Accordingly, a beam spot with a sufficiently small size can be formed on the phosphor screen.

As has been described above, when the superimposition/extension type main lens is used for the electron gun assembly and the main lens aperture is increased, the lens power of the prefocus lens section lowers with a decrease in focus electrode potential. In the present embodiment, however, the additional electrode (third grid) is disposed between the screen electrode (second grid) and focus electrode (fourth grid), and a voltage higher than the focus electrode potential is applied to the additional electrode. Thereby, the prefocus lens section, which is created between the screen electrode and additional electrode, can have a sufficiently high lens power. Hence, it is possible to suppress an increase in diverging angle of each electron beam entering the main lens section and to reduce the effect of spherical aberration in the main lens section. Therefore, the beam spot size on the phosphor screen can be decreased.

Since the additional electrode potential is relatively high, the potential permeating to the screen electrode side becomes higher and the imaginary object point of the electron beam for the main lens section can be reduced in size. Therefore, the beam spot size on the phosphor screen can be decreased.

Besides, the sub-lens section, which decelerates and prefocuses the electron beam, is created between the additional electrode and focus electrode. As regards the features of the sub-lens section, the diverging angle of the electron beam is decreased while the diameter of the electron beam is slightly increased. In addition, the spherical aberration at the main lens section may be increased. However, the lens function of the prefocus lens section having the sufficiently strong focus power is dominant. It is possible, therefore, to sufficiently reduce the diverging angle of the electron beam entering the main lens section, and to alleviate the effect of spherical aberration in the main lens section.

The main lens section is formed as the superimposition/extension type lens. Thereby, the aperture of the main lens section can be increased, and the lens magnification decreased. Thus, a small beam spot can be formed on the phosphor screen.

According to the above-described electron gun assembly, a sufficiently small imaginary object point can be achieved, and the electron beam that enters the main lens section can be maintained at the small size. Moreover, since the magnification of the large-aperture superimposition/extension type main lens section is small, the beam spot size of the electron beam that reaches the phosphor screen can be sufficiently reduced. Therefore, a cathode-ray tube apparatus capable of displaying a high-definition, high-resolution image can be provided.

The present invention is not limited to the above-described first embodiment, and various modifications can be made.

(Second Embodiment)

Figure 6:
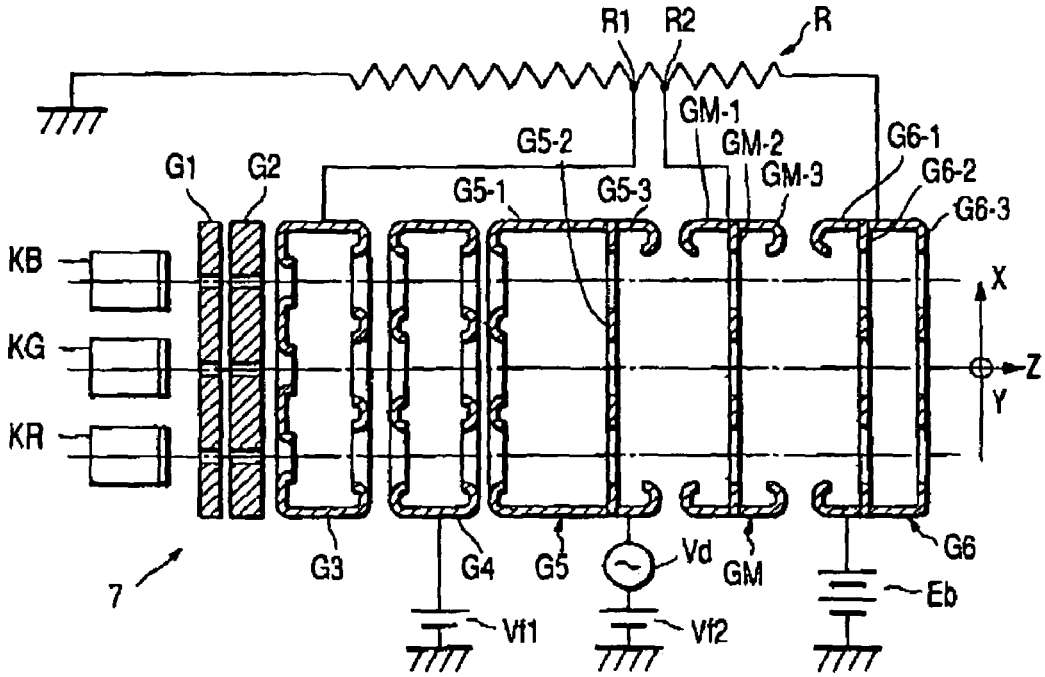
FIG. 6 is a horizontal cross-sectional view that schematically shows the structure of an electron gun assembly according to a second embodiment, which is applicable to the cathode-ray tube apparatus shown in FIG. 1.

An electron gun assembly, which has a similar basic structure to the first embodiment and includes the third grid (additional electrode) and the intermediate electrode that are supplied with different voltages, as shown in FIG. 6, is applicable to the above-described cathode-ray tube apparatus. The parts common to those in the first embodiment are denoted by like reference numerals and a detailed description is omitted.

In the first embodiment, the third grid G3 and intermediate electrode GM are supplied with the same-level voltage from the common voltage supply terminal R0 of the resistor R. By contrast, in the second embodiment, the third grid G3 is supplied with a voltage from a first voltage supply terminal R1 of the resistor R, and the intermediate electrode GM is supplied with a voltage from a second voltage supply terminal R2.

The voltages that are applied to the third grid G3 and intermediate electrode GM are voltages that have levels between the focus voltage and the anode voltage and are obtained by dividing the anode voltage by means of the resistor R. In addition, a voltage, which is always higher than the voltage applied to the third grid G3, is applied to the intermediate electrode GM. With the second embodiment having this structure, the same advantage as in the first embodiment can be obtained.

(Third Embodiment)

Figure 7:
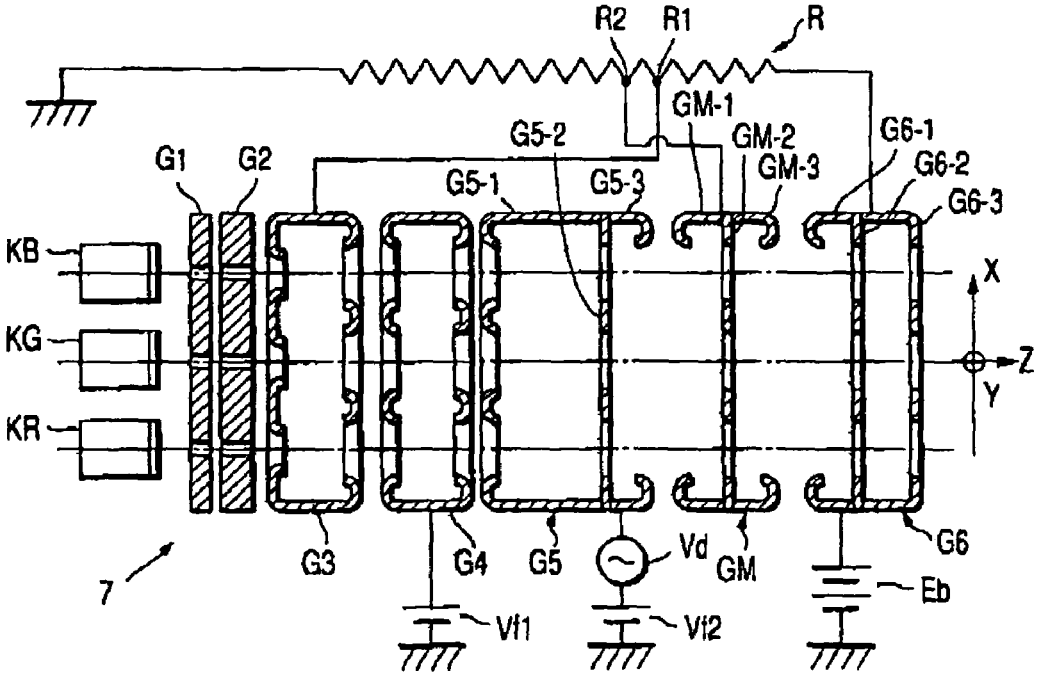
FIG. 7 is a horizontal cross-sectional view that schematically shows the structure of an electron gun assembly according to a third embodiment, which is applicable to the cathode-ray tube apparatus shown in FIG. 1.

In a third embodiment of the invention, as shown in FIG. 7, the third grid G3 is supplied with a voltage from a first voltage supply terminal R1 of the resistor R, and the intermediate electrode GM is supplied with a voltage from a second voltage supply terminal R2.

The voltages that are applied to the third grid G3 and intermediate electrode GM are voltages that have levels between the focus voltage and the anode voltage and are obtained by dividing the anode voltage by means of the resistor R. In addition, a voltage, which is always lower than the voltage applied to the third grid G3, is applied to the intermediate electrode GM. With the third embodiment having this structure, the same advantage as in the first embodiment can be obtained.

(Fourth Embodiment)

Figure 8:
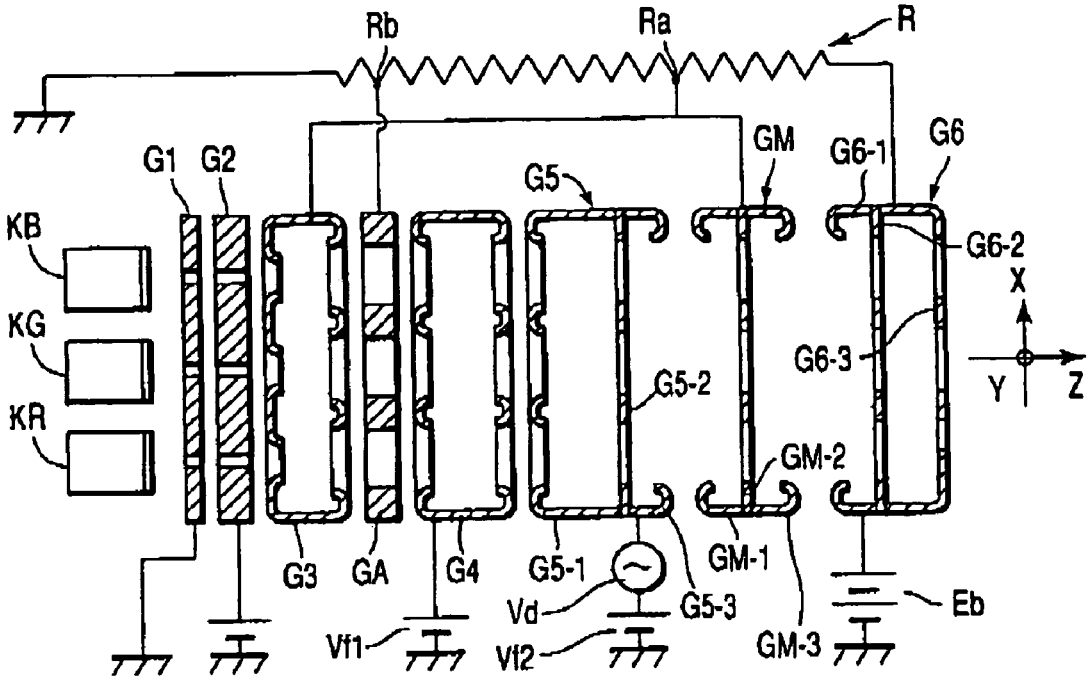
FIG. 8 is a horizontal cross-sectional view that schematically shows the structure of an electron gun assembly according to a fourth embodiment, which is applicable to the cathode-ray tube apparatus shown in FIG. 1.

As is shown in FIG. 8, an electron gun assembly 7 includes three cathodes K (R, G, B) disposed in line in the horizontal direction X, three heaters for individually heating the cathodes K (R, G, B), and eight electrodes. The eight electrodes, that is, a first grid (grid electrode) G1, a second grid (screen electrode) G2, a third grid (first additional electrode) G3, an additional electrode (second additional electrode) GA, a fourth grid (focus electrode) G4, a fifth grid (focus electrode) G5, an intermediate electrode GM and a sixth grid (anode electrode) G6, are disposed in succession from the cathodes K (R, G, B) side toward the phosphor screen in a tube axis direction Z. The fourth grid G4 functions as a first segment of the focus electrode. The fifth grid G5 functions as a second segment of the focus electrode. The cathodes K (R, G, B) and eight electrodes are integrally fixed by a pair of insulation support members.

The first to sixth grids G1 to G6 have substantially the same structures as those described in the first embodiment. In the fourth embodiment, two additional electrodes, that is, the third grid G3 and additional electrode GA, are disposed between the screen electrode G2 and focus electrode G4. The additional electrode GA is formed of a plate electrode. The plate electrode has, in its plate face, three electron beam passage holes that are formed in line in the horizontal direction X in association with the three cathodes K (R, G, B).

In the electron gun assembly 7 with the above-described structure, the cathodes K and the first to sixth grids G1 to G6 are supplied with substantially the same voltages as in the first embodiment. The third grid G3 is supplied with a voltage with a level between the focus voltage and the anode voltage, e.g. a voltage of about 18.0 kV. In addition, the intermediate electrode GM is supplied with a voltage with a level between the focus voltage and the anode voltage, e.g. a voltage of about 18.0 kV. A voltage, which is obtained by dividing the anode voltage Eb by means of the resistor R, is applied to the third grid G3 and intermediate electrode GM. In this embodiment, the third grid G3 and intermediate electrode GM are electrically connected within the tube and are supplied with voltages, which always have the same level, via a voltage supply terminal Ra of the resistor R. A voltage of about 800 V, which is lower than the focus voltage, is applied to the additional electrode GA via a voltage supply terminal Rb of the resistor R.

In the electron gun assembly 7 with this structure, the above-mentioned voltages are applied to the respective grids, thereby constituting an electron beam generating section, a prefocus lens section, a sub-lens section, a quadrupole lens section (non-axial-symmetric lens section) and a main lens section. The electron beam generating section, prefocus lens section, quadrupole lens section and main lens section are configured substantially similarly with the first embodiment. The sub-lens section is formed by at least three electrodes, that is, the third grid G3, additional electrode GA and fourth grid G4.

In this electron gun assembly 7, the electron beam generated from the electron beam generating section is prefocused by the prefocus lens section. The prefocused electron beam passes through the sub-lens section that is formed of the third grid G3, additional electrode GA and fourth grid G4 and undergoes a further prefocus function to become a smaller-size electron beam. The electron beam, which travels toward the peripheral area of the phosphor screen, passes through the quadrupole lens section and undergoes an action that compensates a deflection aberration. On the other hand, the electron beam, which travels toward the central area of the phosphor screen, does not undergo the function of the quadrupole lens section and it enters the main lens section. At last, the electron beam enters the main lens section and is finally accelerated toward the phosphor screen and undergoes a final focusing function.

In the electron gun assembly 7, in addition to the advantageous effect of the first embodiment, the electron beam has a small size before it enters the main lens section, by virtue of the synergistic effect of the prefocus lens section and the sub-lens section. Hence, the electron beam is hardly affected by the lens aberration of the main lens section, and a small beam spot with little deformation can be formed on the phosphor screen.

As mentioned above, when the superimposition/extension type main lens is used in the electron gun assembly and the main lens aperture is thereby increased, the lens power of the prefocus lens section decreases with a decrease in focus electrode potential. In the present embodiment, however, the first additional electrode (third grid) and second additional electrode (additional electrode) are successively disposed between the screen electrode (second grid) and focus electrode (fourth grid). A voltage, which is higher than the focus electrode potential, is applied to the first additional electrode. A voltage, which is lower than the focus electrode potential, is applied to the second additional electrode.

Thus, the prefocus lens section, which is formed between the screen electrode and the first additional electrode, has a sufficiently high lens power. Therefore, the size of the electron beam that enters the main lens section can be reduced.

Since the first additional electrode potential is relatively high, the potential permeating to the screen electrode side becomes higher and the imaginary object point of the electron beam for the main lens section can be reduced in size. Therefore, the beam spot size on the phosphor screen can be decreased.

Besides, the sub-lens section, which further prefocuses the electron beam, is created in the region extending from the first additional electrode to the focus electrode, with the plate-like second additional electrode interposed. The sub-lens section is created by applying a high-level voltage to the first additional electrode, a low-level voltage to the second additional electrode and an intermediate-level voltage to the focus electrode. Compared to the sub-lens section shown in FIG. 12 that does not include the second additional electrode, this sub-lens section can sufficiently suppress the diverging angle of the electron beam and can reduce the size of the electron beam. Therefore, it is possible to alleviate the effect of spherical aberration of the main lens section on the electron beam.

Figure 12:
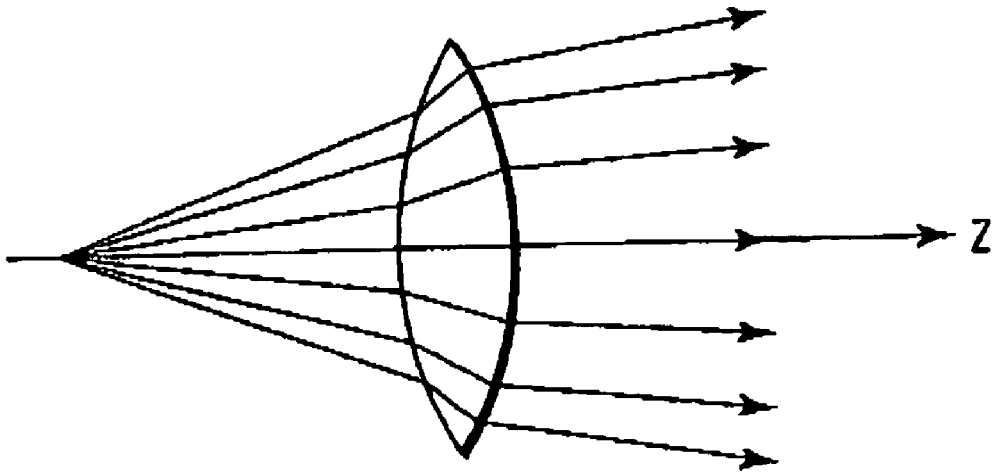
FIG. 12 shows a comparative structural example of a sub-lens section that is applied to an electron gun assembly.

The sub-lens section shown in FIG. 12 is created by applying a high-level voltage to the first additional electrode and a low-level voltage to the focus electrode. The sub-lens section with this structure forms a diverging lens on the front side and a focusing lens on the rear side in the direction of travel of the electron beam. As a result, the focusing effect of the electron beam is obtained but, at the same time, the size of the electron beam is increased. The increase in size of the electron beam makes the electron beam more susceptible to the effect of lens aberration when it passes through the main lens section. Consequently, the size of the beam spot of the electron beam, which reaches the phosphor screen, cannot sufficiently be reduced.

Figure 13:
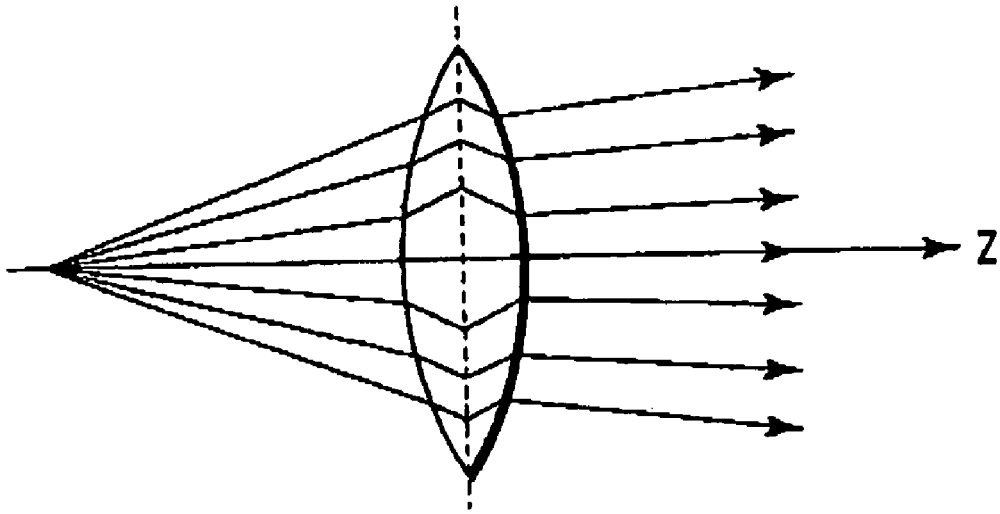
FIG. 13 shows a structural example of a sub-lens section that is applied to the electron gun assemblies shown in FIGS. 8 to 11.

By contrast, the sub-lens section of the present embodiment, as shown in FIG. 13, forms a diverging lens, a focusing lens and a diverging lens in succession from the front side in the direction of travel of the electron beam. As a result, the focusing effect for reducing the diverging angle of the electron beam is obtained and, at the same time, the effect of reducing the size of the electron beam is obtained. Accordingly, the size of the electron beam that enters the main lens section can be reduced. Therefore, it is possible to sufficiently reduce the diverging angle of the electron beam that enters the main lens section, and to alleviate the effect of spherical aberration of the main lens section.

The main lens section is formed as the superimposition/extension type lens. Thereby, the aperture of the main lens section can be increased, and the lens magnification decreased. Thus, a small beam spot can be formed on the phosphor screen.

According to the electron gun assembly of the fourth embodiment, a sufficiently small imaginary object point can be achieved, and the electron beam that enters the main lens section can be maintained at the small size. Moreover, since the magnification of the large-aperture superimposition/extension type main lens section is small, the beam spot size of the electron beam that reaches the phosphor screen can be sufficiently reduced. Therefore, a cathode-ray tube apparatus capable of displaying a high-definition, high-resolution image can be provided.

The present invention is not limited to the above-described embodiment, and various modifications can be made in practice without departing from the spirit of the invention.

(Fifth Embodiment)

Figure 9:
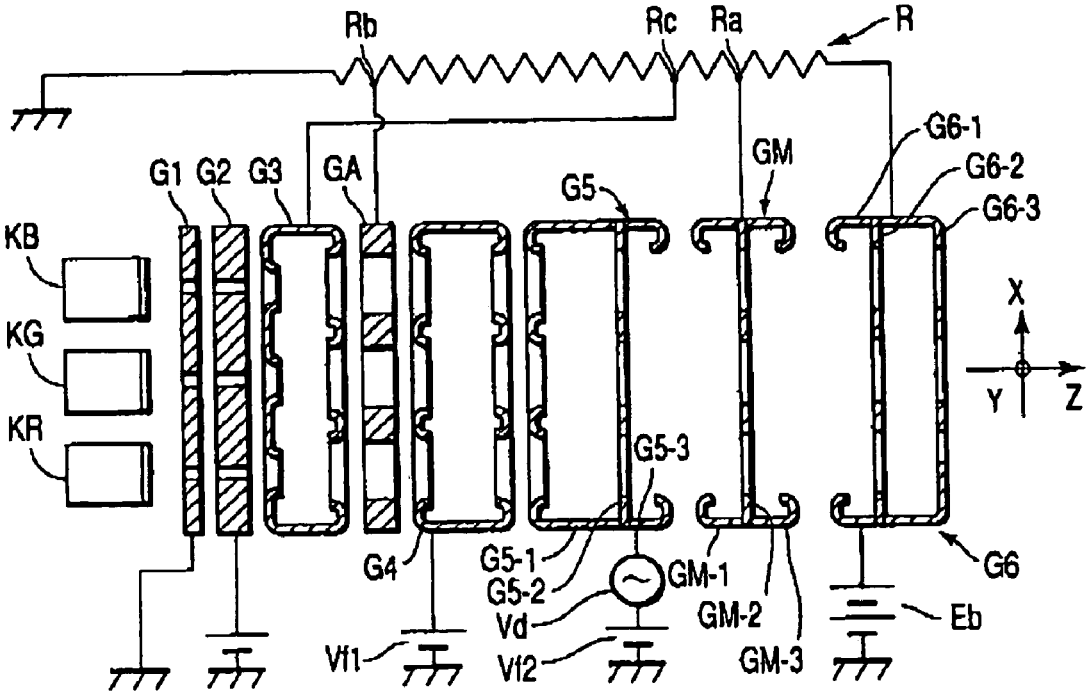
FIG. 9 is a horizontal cross-sectional view that schematically shows the structure of an electron gun assembly according to a fifth embodiment, which is applicable to the cathode-ray tube apparatus shown in FIG. 1.

An electron gun assembly, which has a similar basic structure to the fourth embodiment and includes the third grid (first additional electrode) and the intermediate electrode that are supplied with different voltages, as shown in FIG. 9, is applicable to the above-described cathode-ray tube apparatus. The parts common to those in the fourth embodiment are denoted by like reference numerals and a detailed description is omitted.

In the fifth embodiment, the intermediate electrode GM is supplied with a voltage from a voltage supply terminal Ra. The third grid G3 is supplied with a voltage from a voltage supply terminal Rc. The voltages that are applied to the third grid G3 and intermediate electrode GM are voltages that have levels between the focus voltage and the anode voltage and are obtained by dividing the anode voltage by means of the resistor R. In addition, a voltage, which is always higher than the voltage applied to the third grid G3, is applied to the intermediate electrode GM. With the fifth embodiment having this structure, the same advantage as in the fourth embodiment can be obtained.

(Sixth Embodiment)

Figure 10:
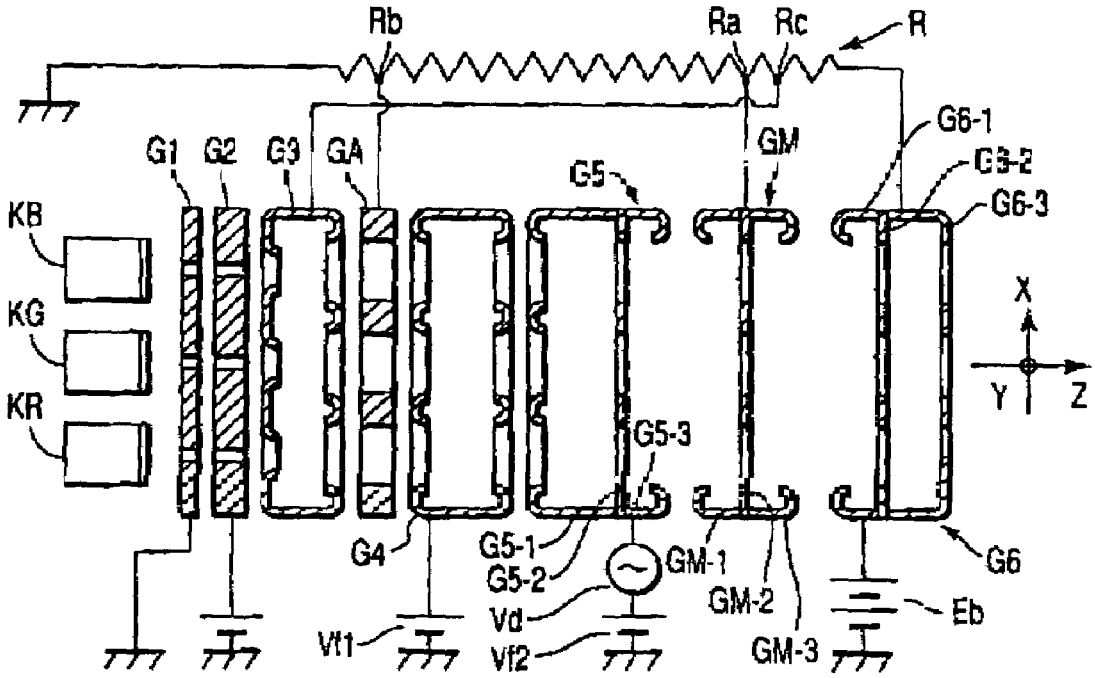
FIG. 10 is a horizontal cross-sectional view that schematically shows the structure of an electron gun assembly according to a sixth embodiment, which is applicable to the cathode-ray tube apparatus shown in FIG. 1.

In a sixth embodiment, as shown in FIG. 10, the intermediate electrode GM is supplied with a voltage from a voltage supply terminal Ra. The third grid G3 is supplied with a voltage from a voltage supply terminal Rc. The voltages that are applied to the third grid G3 and intermediate electrode GM are voltages that have levels between the focus voltage and the anode voltage and are obtained by dividing the anode voltage by means of the resistor R. In addition, a voltage, which is always lower than the voltage applied to the third grid G3, is applied to the intermediate electrode GM. With the sixth embodiment having this structure, the same advantage as in the fourth embodiment can be obtained.

(Seventh Embodiment)

Figure 11:
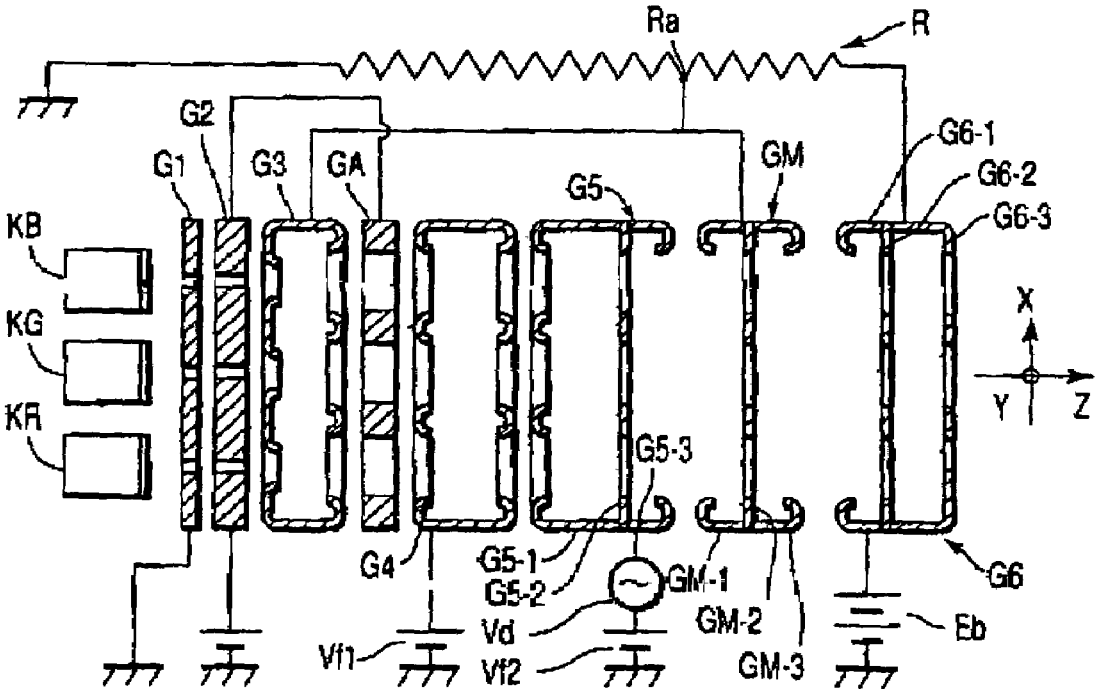
FIG. 11 is a horizontal cross-sectional view that schematically shows the structure of an electron gun assembly according to a seventh embodiment, which is applicable to the cathode-ray tube apparatus shown in FIG. 1.

In a seventh embodiment, as shown in FIG. 11, the additional electrode GA is electrically connected to the second grid G2 within the tube and is supplied with a voltage that always has the same level as the voltage applied to the second grid G2. Needless to say, with this structure, the same advantage as in the fourth embodiment can be obtained.

In each of the above-described embodiments, one intermediate electrode is disposed between the focus electrode and the anode electrode. Alternatively, two or more intermediate electrodes may be disposed. In addition, a plurality of additional electrodes may be disposed between the screen electrode and the focus electrode.

In each of the above-described embodiments, all electrodes that constitute the superimposition/extension type main lens section include cylindrical bodies. It should be noted, however, that the superimposition/extension type main lens section can be created if at least one of the electrodes includes a cylindrical body. In other words, the superimposition/extension type main lens section can be formed if a cylindrical body (cylindrical electrode) that extends in the direction of travel of the electron beam is provided on at least one of the opposed surfaces of the focus electrode, intermediate electrode and anode electrode.

Figure 14:
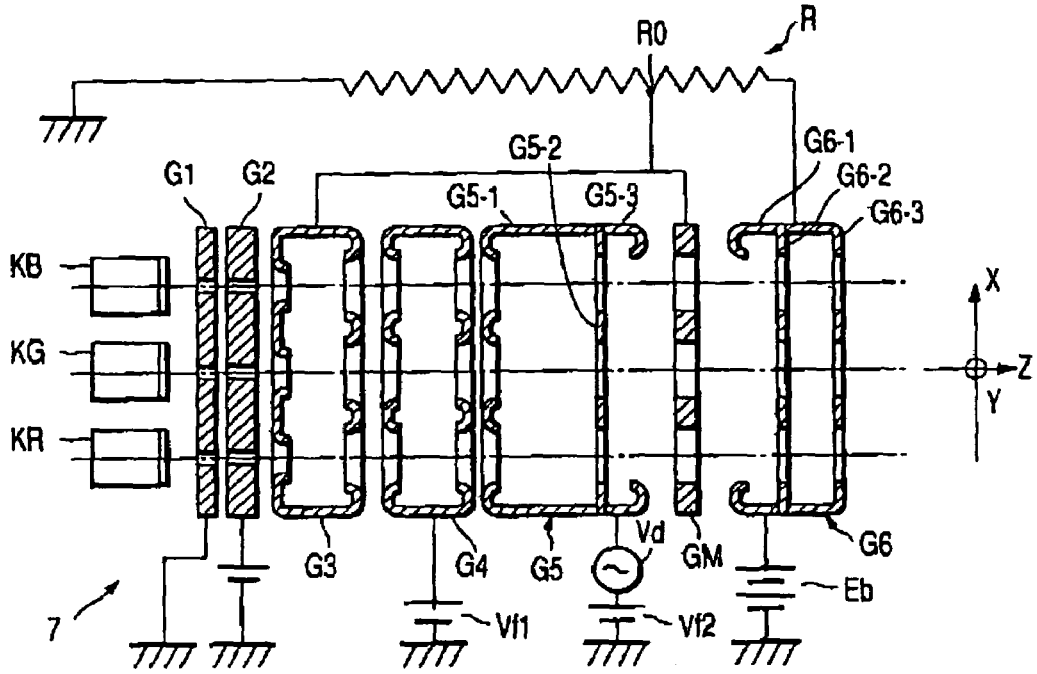
FIG. 14 shows another structural example of the superimposition/extension type main lens section that is applicable to the electron gun assembly according to each embodiment.
Figure 15:
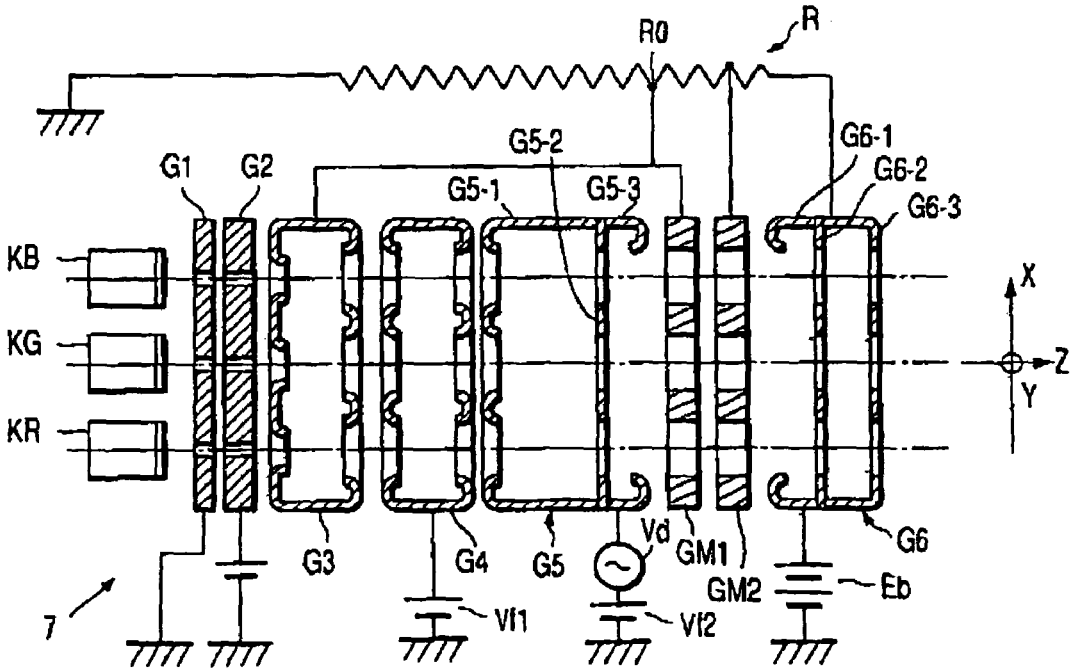
FIG. 15 shows another structural example of the superimposition/extension type main lens section that is applicable to the electron gun assembly according to each embodiment.

For example, as shown in FIG. 14, the intermediate electrode GM of the superimposition/extension type main is lens section may be a plate electrode, Besides, as shown in FIG. 15, the superimposition/extension type main lens section may include two intermediate electrodes between the focus electrode G5 and anode electrode G6, that is, plate electrodes GM1 and GM2. In the examples shown in FIGS. 14 and 15, the intermediate electrode has no cylindrical body at its faces opposed to the focus electrode G5 and anode electrode G6. However, the focus electrode G5 and anode electrode G6 have cylindrical bodies G5-3 and G6-1 at their faces opposed to the intermediate electrode. Thus, the superimposition/extension type main lens section is formed.

Figure 16:
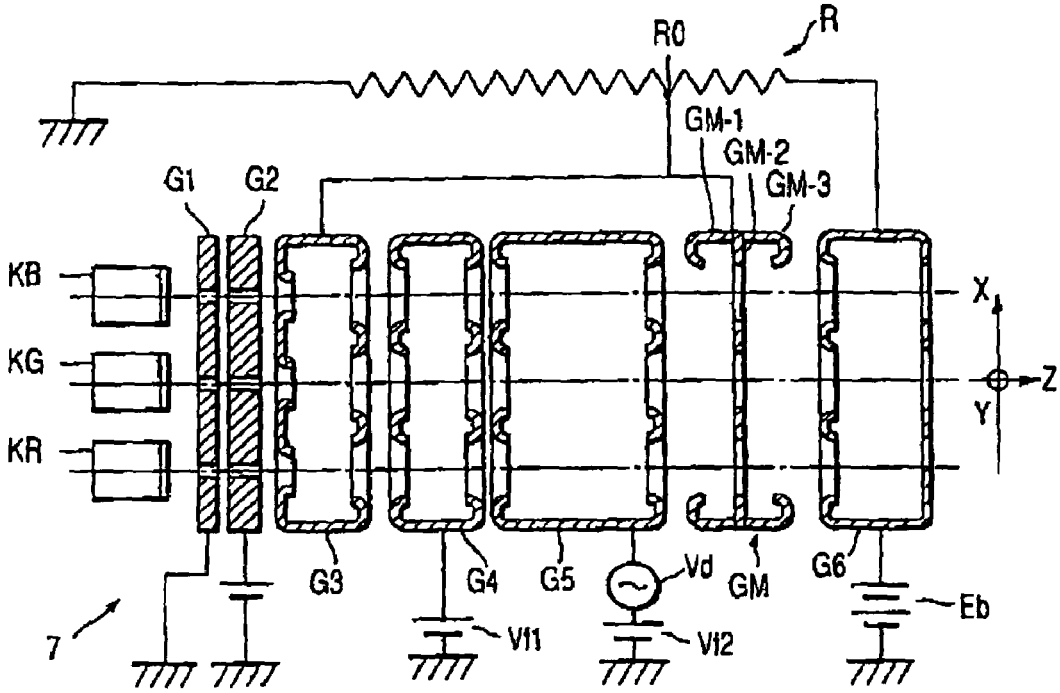
FIG. 16 shows another structural example of the superimposition/extension type main lens section that is applicable to the electron gun assembly according to each embodiment.
Figure 17:
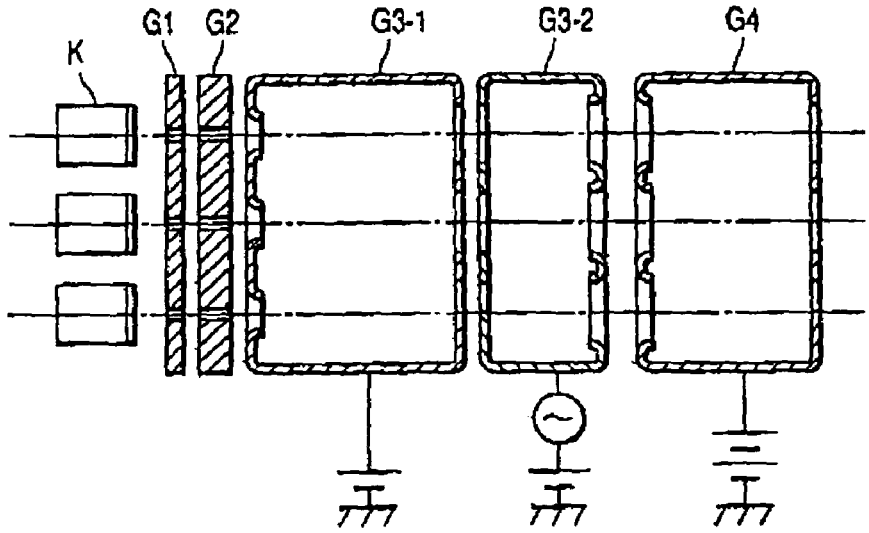
FIG. 17 PRIOR ART
FIG. 17 is a horizontal cross-sectional view that schematically shows the structure of an electron gun assembly that is applied to a prior-art cathode-ray tube apparatus.
Figure 18:
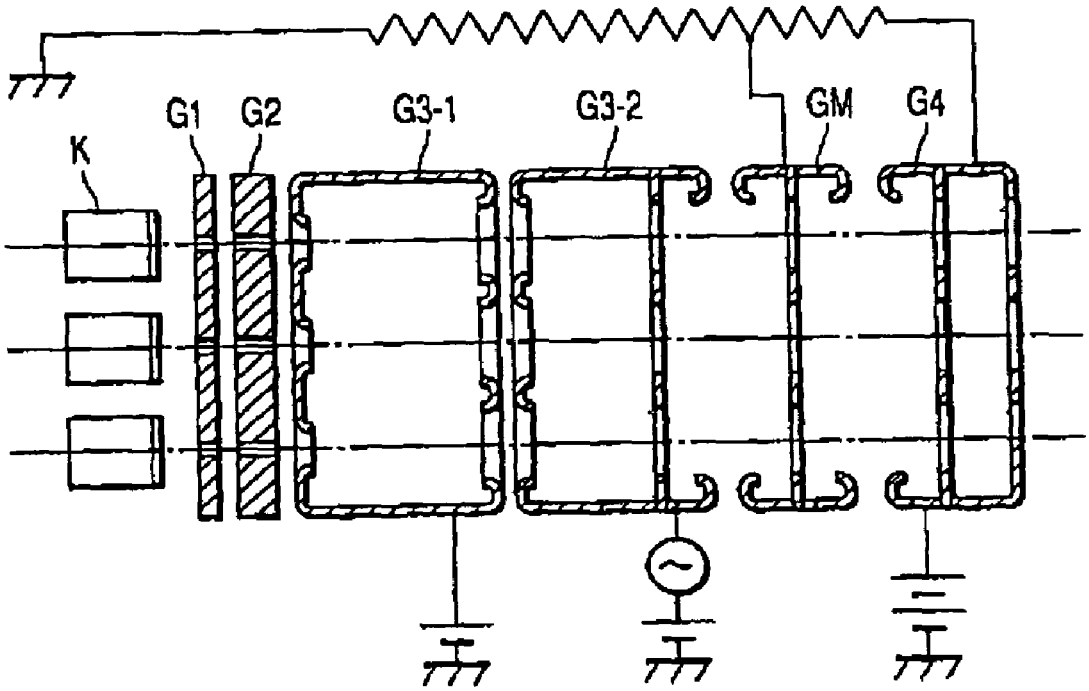
FIG. 18 PRIOR ART
FIG. 18 is a horizontal cross-sectional view that schematically shows the structure of a prior-art electron gun assembly with a superimposition/extension type main lens.

A superimposition/extension type main lens section shown in FIG. 16 includes a focus electrode G5 and an anode electrode G6, each of which is formed of a single cylindrical electrode. The focus electrode G5 and anode electrode G6 include no cylindrical body on its faces opposed to the intermediate electrode GM. However, the intermediate electrode GM includes cylindrical bodies GM-1 and GM-3 on its faces opposed to the focus electrode G5 and anode electrode G6. Thus, the superimposition/extension type main lens section is constructed. Needless to say, even in the case where the focus electrode G5 alone or the anode electrode G6 alone is formed of a single cylindrical electrode, the superimposition/extension type main lens section can be formed if the intermediate electrode GM includes cylindrical bodies between itself and these electrodes. In the examples shown in FIG. 14 to FIG. 16, the electron gun assembly includes only one additional electrode G3. However, various types of superimposition/extension type main lens sections can be formed in an electron gun assembly having two additional electrodes G3 and GA.

According to the electron gun assembly with the superimposition/extension type main lens section that has been described with reference to FIG. 14 to FIG. 16, the same advantages effects as in the above-described embodiments can be obtained.

The embodiments, when practiced, may properly be combined as much as possible. In this case, advantages are obtained by the combinations.

As has been described above, the present invention can provide a cathode-ray tube apparatus capable of stably displaying a high-definition, high-resolution image.

What is claimed is:

1. A cathode-ray tube apparatus comprising:

an electron gun assembly including an electron beam generating section that generates an electron beam, a prefocus lens section that prefocuses the electron beam generated from the electron beam generating section, and a main lens section that accelerates and focuses the prefocused electron beam onto a phosphor screen;

a deflection yoke that generates deflection magnetic fields for deflecting the electron beam emitted from the electron gun assembly in a horizontal direction and a vertical direction on the phosphor screen; and a sub-lens section between the prefocus lens section and the main lens section, wherein the main lens section includes a focus electrode, to which a focus voltage is applied, an anode electrode, to which an anode voltage with a level higher than the focus voltage is applied, and at least one intermediate electrode, to which a voltage with a level between the focus voltage and the anode voltage is applied, said at least one intermediate electrode being disposed between the focus electrode and the anode electrode, each of the focus electrode, the anode electrode and the intermediate electrode includes, at opposed faces thereof, at least one cylindrical body extending in a direction of travel of the electron beam, the prefocus lens section includes a screen electrode, to which a voltage with a level lower than the focus voltage is applied, and at least one additional electrode, to which a voltage with a level between the focus voltage and the anode voltage, is applied, and the sub-lens section is configured to decelerate and further prefocus the electron beam that is prefocused by the prefocus lens section.

2. The cathode-ray tube apparatus according to claim 1, wherein the additional electrode comprises a cylindrical electrode.

3. The cathode-ray tube apparatus according to claim 1, further comprising a resistor that divides the anode voltage, wherein a voltage obtained by dividing the anode voltage by means of the resistor is applied to the additional electrode and the intermediate electrode.

4. The cathode-ray tube apparatus according to claim 1, wherein the focus electrode comprises at least two segments, and a non-axial-symmetric lens section having different focusing powers in the horizontal direction and vertical direction is provided between said segments when the electron beam is deflected.

5. The cathode-ray tube apparatus according to claim 4, wherein the non-axial-symmetric lens section has a focusing function in the horizontal direction and a diverging function in the vertical direction.

6. The cathode-ray tube apparatus according to claim 1, wherein a voltage, which is always lower than the voltage applied to the additional electrode, is applied to the intermediate electrode.

7. The cathode-ray tube apparatus according to claim 1, wherein the additional electrode and the intermediate electrode are electrically connected and are supplied with voltages that always have the same level.

8. The cathode-ray tube apparatus according to claim 1, wherein a voltage, which is always higher than the voltage applied to the additional electrode, is applied to the intermediate electrode.

9. A cathode-ray tube apparatus comprising:

an electron gun assembly including an electron beam generating section that generates an electron beam, a prefocus lens section that accelerates and prefocuses the electron beam generated from the electron beam generating section, a sub-lens section that further prefocuses the electron beam prefocused by the prefocus lens section, and a main lens section that accelerates and focuses the electron beam prefocused by the sub-lens section onto a phosphor screen; and a deflection yoke that generates deflection magnetic fields for deflecting the electron beam emitted from the electron gun assembly in a horizontal direction and a vertical direction on the phosphor screen, wherein the prefocus lens section includes at least a screen electrode and a first additional electrode, the sub-focus section includes at least the first additional electrode, a second additional electrode, and a focus electrode to which a focus voltage is applied, the main lens section includes the focus electrode, at least one intermediate electrode, and an anode electrode to which an anode voltage with a level higher than the focus voltage is applied, and each of the focus electrode, the intermediate electrode and the anode electrode includes, on at least one of opposed faces thereof, one cylindrical body extending in a direction of travel of the electron beam, a voltage with a level lower than the focus voltage is applied to the screen electrode, a voltage with a level between the focus voltage and the anode voltage is applied to the first additional electrode and the intermediate electrode, and a voltage with a level lower than the focus voltage is applied to the second additional electrode, and the first additional electrode is formed of a cylindrical electrode having electron beam passage holes at end faces thereof that are opposed to the screen electrode and the second additional electrode, and the second additional electrode is formed of a plate electrode with electron beam passage holes.

10. The cathode-ray tube apparatus according to claim 9, wherein the second additional electrode and the screen electrode are electrically connected and are supplied with voltages that always have the same level.

11. The cathode-ray tube apparatus according to claim 9, further comprising a resistor that divides the anode voltage, wherein a voltage obtained by dividing the anode voltage by means of the resistor is applied to the first additional electrode and the intermediate electrode.

12. The cathode-ray tube apparatus according to claim 9, wherein the focus electrode comprises at least two segments, and a non-axial-symmetric lens section having different focusing powers in the horizontal direction and vertical direction is provided between said segments when the electron beam is deflected.

13. The cathode-ray tube apparatus according to claim 12, wherein the non-axial-symmetric lens section has a focusing function in the horizontal direction and a diverging function in the vertical direction.

14. The cathode-ray tube apparatus according to claim 12, wherein a dynamic focus voltage that is produced by superimposing an AC voltage component, which varies in synchronism with the deflection magnetic fields, on a reference voltage, is applied to at least one of said segments.

15. The cathode-ray tube apparatus according to claim 9, wherein the first additional electrode and the intermediate electrode are electrically connected and are supplied with voltages that always have the same level.

16. The cathode-ray tube apparatus according to claim 9, wherein a voltage, which is always higher than the voltage applied to the first additional electrode, is applied to the intermediate electrode.

17. The cathode-ray tube apparatus according to claim 9, wherein a voltage, which is always lower than the voltage applied to the first additional electrode, is applied to the intermediate electrode.

* * * * *